US007185738B1

(12) United States Patent
Clepper

(10) Patent No.: US 7,185,738 B1
(45) Date of Patent: Mar. 6, 2007

(54) MODULAR SAW HORSE

(76) Inventor: Jerry Clepper, 5747 Railroad Blvd., Wyoming, MN (US) 55092

( * ) Notice: Subject to any disclaimer, the term of this patent is extended or adjusted under 35 U.S.C. 154(b) by 52 days.

(21) Appl. No.: 11/103,686

(22) Filed: Apr. 12, 2005

(51) Int. Cl.
*E04G 1/34* (2006.01)
*E04G 1/32* (2006.01)

(52) U.S. Cl. ..... 182/155; 182/225

(58) Field of Classification Search ..... 182/153, 182/151, 181.1, 225, 224, 182.4, 155, 186.5, 182/186.2, 186.1
See application file for complete search history.

(56) References Cited

U.S. PATENT DOCUMENTS 2,412,716 A * 12/1946 Campbell ..... 182/155
3,008,535 A * 11/1961 De Vries ..... 182/186.4
3,058,542 A * 10/1962 Rogalla ..... 182/155
3,110,360 A * 11/1963 Hearn ..... 185/155
3,167,290 A * 1/1965 Beckwell ..... 248/163.1
3,633,709 A * 1/1972 Weser ..... 182/155
3,637,045 A * 1/1972 Poffenbaugh et al. ..... 182/155
3,817,349 A * 6/1974 Barthel ..... 182/155
4,030,565 A * 6/1977 Chaput ..... 182/151
4,296,834 A * 10/1981 Kroger ..... 182/155
4,319,663 A * 3/1982 Barden ..... 182/154
4,403,678 A * 9/1983 Zieg ..... 182/153
4,489,808 A * 12/1984 Voye ..... 182/155
4,711,319 A * 12/1987 Sansotta et al. ..... 182/155
4,754,844 A * 7/1988 Sutton ..... 182/155
4,771,863 A * 9/1988 Stansberry ..... 182/155
4,782,917 A * 11/1988 Schulz ..... 182/182.2
4,926,966 A * 5/1990 Boudreau ..... 182/155
5,704,450 A * 1/1998 Lunceford ..... 182/153
5,878,839 A * 3/1999 Lin ..... 182/181.1
6,092,627 A * 7/2000 Burger ..... 182/186.5
6,129,180 A * 10/2000 Brady ..... 182/186.4
6,564,903 B2 * 5/2003 Krajec ..... 182/153
6,830,129 B1 * 12/2004 Rose ..... 182/129

* cited by examiner

*Primary Examiner*—Hugh B. Thompson, II
(74) *Attorney, Agent, or Firm*—D L Tschida

(57) ABSTRACT

A work piece support assembly having a primary section and two wing sections that can be arranged in a variety of modular configurations. The sections are hinged to collapse, stack and mount into a compact package for storage or transport. A portion of one set of collapsed legs project to provide a handhold for transport. Bi-axial leg hinge brackets secure the legs to primary and wing rail members. The legs fold between parallel and splayed, Λ-shaped alignments relative to each other along a first axis. The legs independently fold along a second axis between orthogonal and parallel alignments to the adjoining rail member. Retainers at the primary leg brackets interlock and contain the wing sections. Fittings at the wing and primary support rail members interlock to provide different geometric support configurations that accommodate tool movement without the necessity of re-orienting a work piece or the primary or wing support sections.

13 Claims, 10 Drawing Sheets

MODULAR SAW HORSE

BACKGROUND OF THE INVENTION

The present invention relates to work piece supports and, in particular, to a multi-section saw horse assembly wherein multiple wing sections disassemble, fold and store within a primary support section and wherein the multiple sections can be deployed in a variety of support configurations.

Work piece supports have been constructed in a variety of designs for a variety of applications. Sawhorses are one type of support commonly used by carpenters and home handypersons for woodworking, new construction and remodeling projects. These supports typically provide pairs of A-shaped legs that support an intermediate runner. The individual sawhorses are commonly constructed to stack on each other for storage or transport.

Most typically sawhorses are constructed with rigid legs to prevent against collapse. Some hinged designs fold flat. Some designs provide end brackets that accept lengths of 2×4 stock. Some designs provide a rail piece that accepts rollers and/or tool holders, for example, a miter saw, router etc.

Varieties of table top supports also exist that provide horizontal sections that separate and the peripheral edges of which can be drawn together to clamp and contain work pieces or tools. The table surfaces can also act as a sawhorse. The support legs may fold such that the table assembly folds generally flat for transport or storage.

The present invention was developed to provide a hybrid sawhorse assembly that disassembles, stacks and stores into a compact, self-carry package and accommodates a wide-variety of support configurations. The assembly includes one primary section and a pair of wing sections. The sections provide bi-axially hinged legs. The wing section legs fold substantially flat, store with the primary section and are restrained such that a leg provides a handhold for transport.

SUMMARY OF THE INVENTION

It is a primary object of the present invention to provide a collapsible work piece support assembly.

It is a further object of the present invention to provide a multi-section support assembly wherein the sections are detachable and can be interconnected in a variety of work support configurations.

It is a further object of the invention to provide a multi-section support assembly having hinged legs that pivot along one or more axes.

It is a further object of the invention to provide a multi-section support assembly having biaxial hinged legs that fold along one axis between A-shaped and parallel orientations and pivot along another axis between orthogonal and parallel orientations to a rail support member.

It is a further object of the invention to provide a multi-section support assembly wherein hinged leg brackets include retainers to contain the collapsed wing sections to a primary section.

The foregoing objects, advantages and distinctions of the invention, among others, are found in a presently preferred assembly that provides a primary support section and a pair of wing support sections. The sections are hinged to collapse, stack and mount into a single compact package. A portion of the collapsed legs project to provide a handhold for transport.

Each section includes at least one pair of legs that are hinged to fold along two axes. That is, the legs are fastened to a rail member and fold between parallel and A-shaped alignments and once folded independently fold along a second axis between orthogonal and parallel alignments to a rail member. A main or primary support section includes a pair of bi-axially folding legs secured to hinge brackets at opposite ends of a primary rail member. Each wing section includes a single set of bi-axially hinged legs that depend from a wing rail member and which wing rail members interlock in different arrangements with the primary rail member. Retainers affixed to brackets at the primary support section capture one end of the wing sections and the other ends overlap and fasten together, such that a portion of the folded legs act as a handle.

Still other objects, advantages and distinctions of the invention will become more apparent from the following description with respect to the appended drawings. Considered alternative constructions, improvements or modifications are described as appropriate. The singular features may also be combined into a variety of different combinations. The following description should therefore not be literally construed in limitation of the invention. Rather, the scope of the invention should be broadly interpreted within the scope of the further appended claims.

DESCRIPTION OF THE PREFERRED EMBODIMENT

Figure 1:
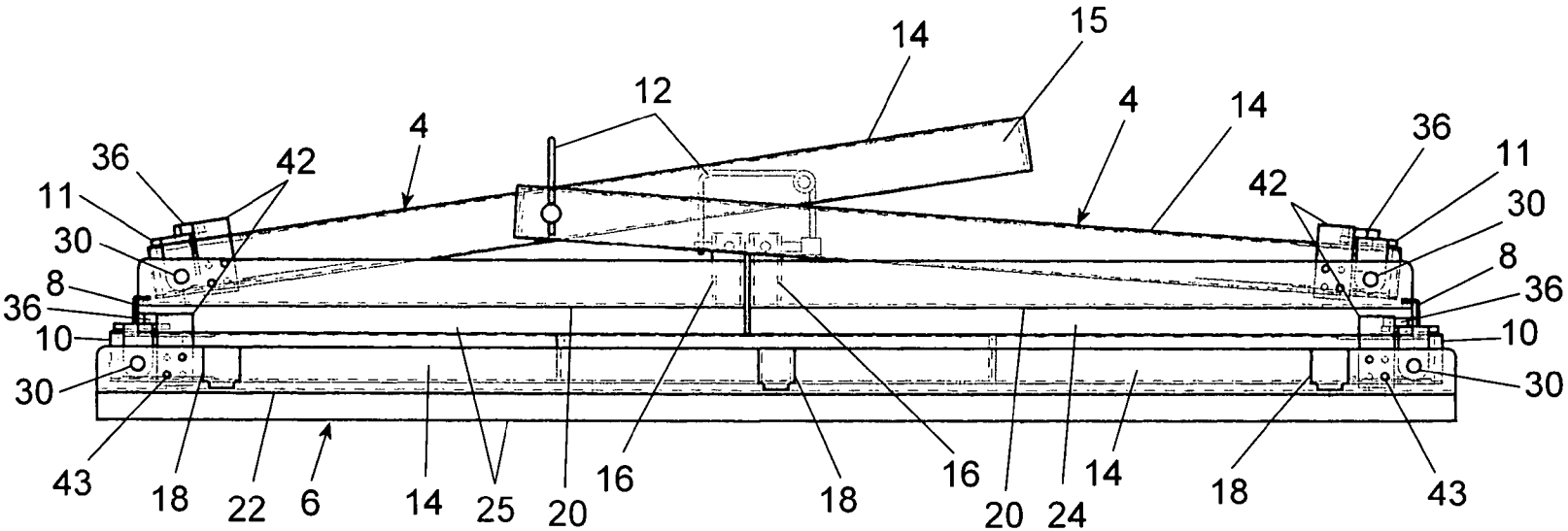
FIG. 1 shows a front plan view of the sawhorse assembly collapsed with the wing-sections secured to the primary section for transport or storage.

With attention to FIG. 1, a view is shown to the modular work piece support or sawhorse assembly 2 of the subject invention in a storage or transport condition. The assembly 2 provides two wing support sections 4 that are secured to a primary support section 6. The wing sections 4 are secured beneath end clips or retainers 8 at leg pivot brackets 10 mounted to each end of the primary section 6. A first spring clip 12 is secured to overlapped portions of folded pairs of legs 14 at the two wing sections 4. The legs 14 are aligned such that a portion 15 of the folded legs 14 of the one wing section 4 project to provide a handhold to facilitate carrying the assembly 2.

A second spring clip 12 is secured between two mounting pins 16 that depend from the adjoining ends of the two wing sections 4 to prevent the release of the wing sections 4 from the retainers 8. The assembly 2 is thus compactly collapsed for ready transport or storage.

Figures 2A, 2B:
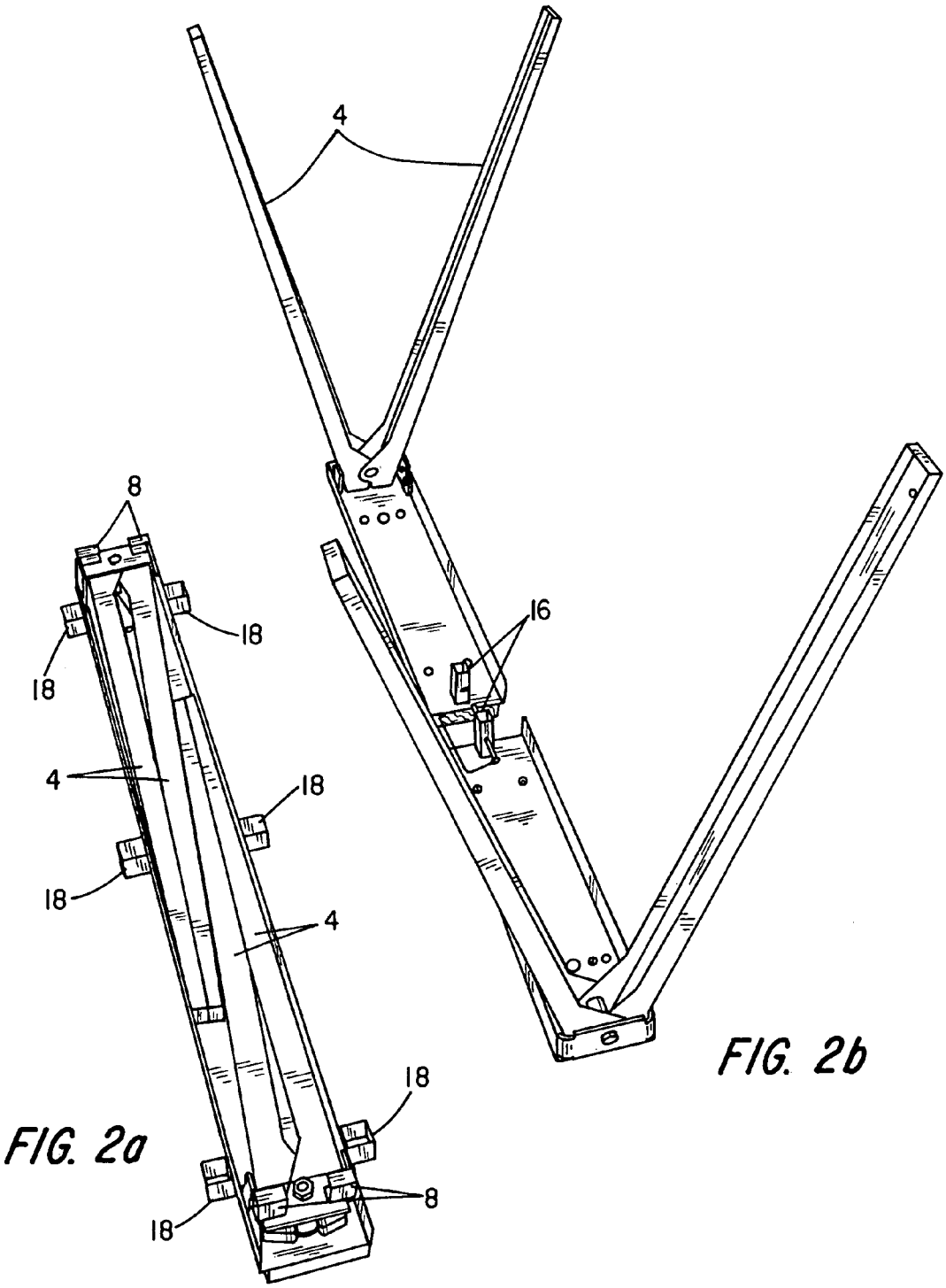
FIG. 2*a* shows a perspective view of the wing sections disassembled from the primary section of the sawhorse assembly.
FIG. 2*b* shows the legs of the wing sections folded out and partially splayed open.
Figure 5:
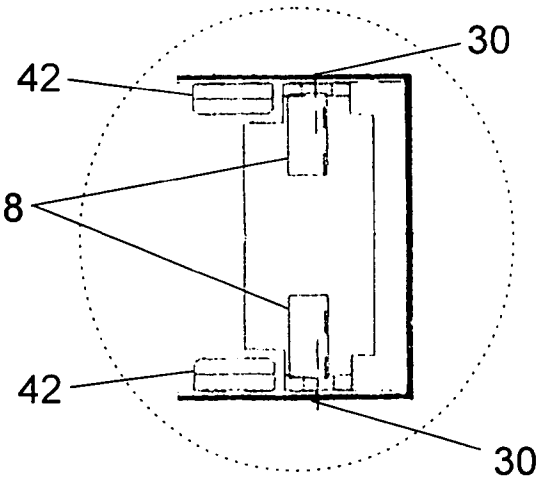
FIG. 5 shows a detailed section view a bi-axial, retainer hinge bracket of the primary support section.
Figure 3:
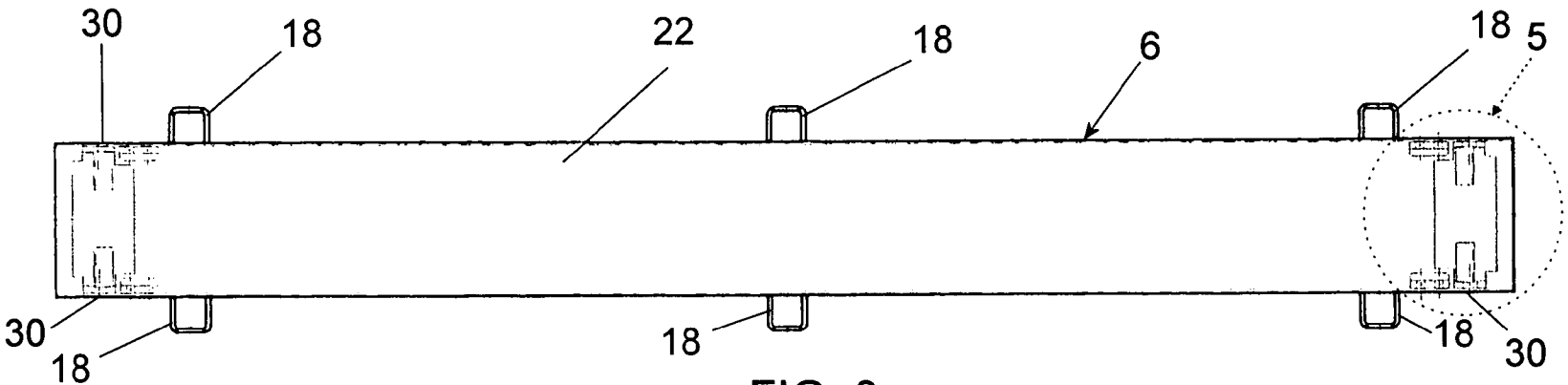
FIG. 3 shows a top view of the primary section.
Figure 4:
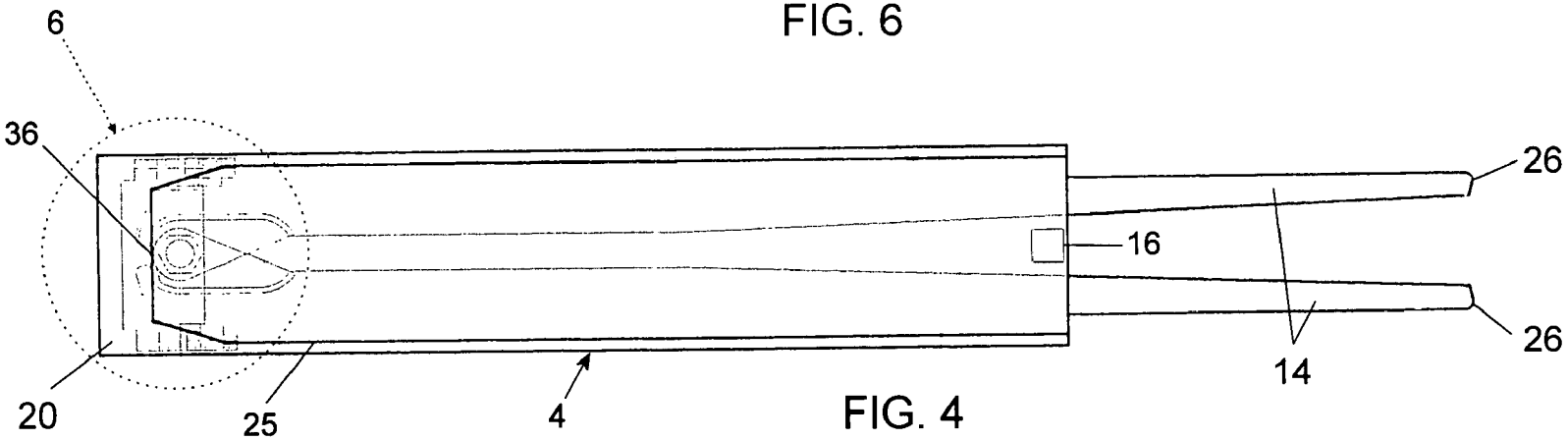
FIG. 4 shows a top view of one of the wing sections.
Figure 9:
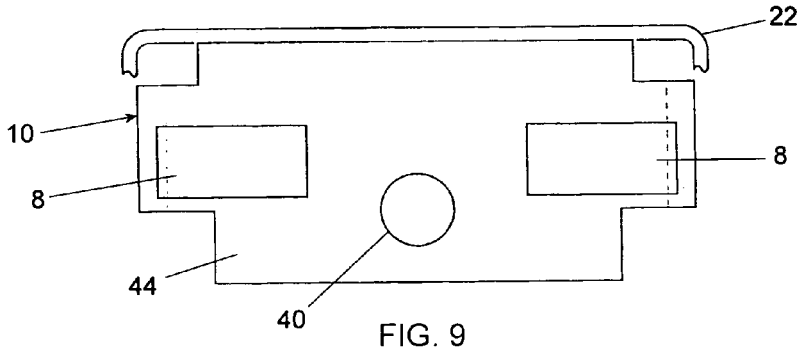
FIG. 9 shows a top view of the bi-axial, hinge bracket of the primary support section.
Figure 7:
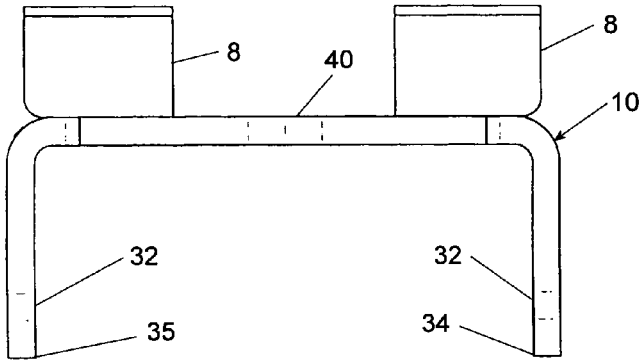
FIG. 7 shows a front view of the bi-axial, retainer hinge bracket of the primary support section.
Figure 8:
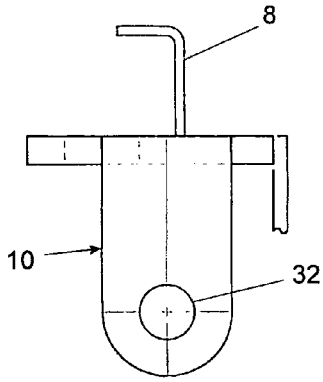
FIG. 8 shows a right side view of the bi-axial, hinge bracket of the primary support section.

FIGS. 2 through 4 show views to the general configuration of the primary support section 6 and each of the wing support sections 4. FIGS. 5 through 10, in turn, depict detailed views to the construction of the bi-axial hinge pivot brackets 10 and 11 that respectively secure the legs 14 to the primary and wing support sections 4 and 6.

When disassembled for normal use and as shown at FIGS. 11 through 15, several alternative mounting arrangements of the primary and wing sections 4 and 6 are shown. Depending upon the project, the different arrangements support a work piece in a fashion such that a tool (e.g. saw or router) can be used without having to rearrange the sections 4 and 6 during a work task. In each arrangement, the wing sections 4 are fitted to the primary section 6 with a depending pin 16. The pins 16 extend from the bottom of a wing rail member 20 at each wing section 4. Each pin 16 mounts to a selected one of a number of open-ended sockets 18 that extend from the longitudinal sides of a rail member 22 at the primary section 6. The pins 16 and sockets 18 are welded to the support sections 4 and 6.

Depending upon a work task and/or a work piece that is to be supported on the assembly 2, the sections 4 and 6 are normally arranged to span the work area of the supported wood or metal work piece. The sawing, drilling, routing or other task can then be performed without the tool striking any of the support sections 4 or 6. Advantageously, the work can be performed without having to rearrange the support sections 4 and 6 during the task. Previously, multiple saw horses or supports were required or it was necessary to rearrange the supports during the task, but which is no longer required.

The pins 16 and sockets 18 are constructed of lengths of square tube stock. When interlocked in a telescoping fashion, the square circumference of the pins 16 and square bores at the sockets 18 prevent the wings 4 from rotating relative to the primary section 6. The sections 4 and 6 are thus restricted to various transverse relative mounting relationships. A variety of other mating shapes may be used at the pins 16 and sockets 18. For example, round pins 16 and sockets 18 or other configurations might alternatively be used to permit a hinged rotation of the sections 4 and 6 to achieve an expanded range of mounting permutations of the sections 4 and 6. The types and locations of the interlocking fasteners (e.g. pins 16 and sockets 18) can be varied to accommodate any desired geometric arrangement of the support sections 4 and 6. Separate fasteners (e.g. lynch pins) may be used to latch the couplings between the pins 16 and sockets 18.

With attention to FIGS. 3 through 10, the legs 14 and the rail support pieces 20 and 22 are generally formed as channel pieces from steel sheet stock selected in the nominal range of 6 to 12 guage. Different materials and/or materials of different thickness can be used depending upon the weights of the loads to be supported.

An appropriate cover piece 24 of another material can be secured to the top of each of the rail support pieces 20 and 22. Presently a wood cover piece 25 is attached to each of the support sections 4 and 6. The cover pieces 25 protect each of the underlying metal rail pieces 20 and 22 from contact with any tools, for example, a saw blade or other tool bit or blade that might traverse over one of the tops of the cover pieces 25.

Figure 6:
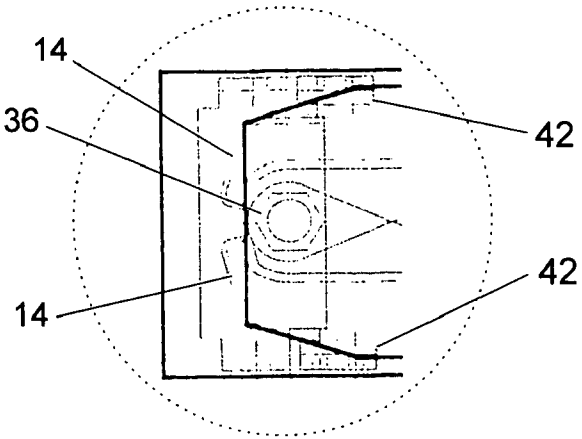
FIG. 6 shows a detailed section view of a bi-axial, hinge bracket of a wing support section.

The side webs of the rail channel pieces are bent with suitable forming equipment. The ends of the rail piece 22 are left open to accept the bi-axial, retainer hinge brackets 10 shown at FIGS. 3, 5, and 7–9. Substantially identical biaxial hinge brackets 11 are shown at FIGS. 4 and 6 and are secured to the rail piece 20 of each wing support 4. The brackets 11 differ from the brackets 10 in that they don't include retainer clips 8. The brackets 11 are secured to the ends of the rail pieces 20 opposite to the pins 16.

Folded tabs 24 and 26 are formed at the opposite ends of the legs 14. The tabs support the assembly 2 on the ground or floor. Non-marring caps or pads (not shown) can be mounted over the tabs 26. Threaded, level adjuster pads (not shown) can also be secured to the tabs 26 or legs 14 to facilitate leveling when working on uneven surfaces.

Figure 10:
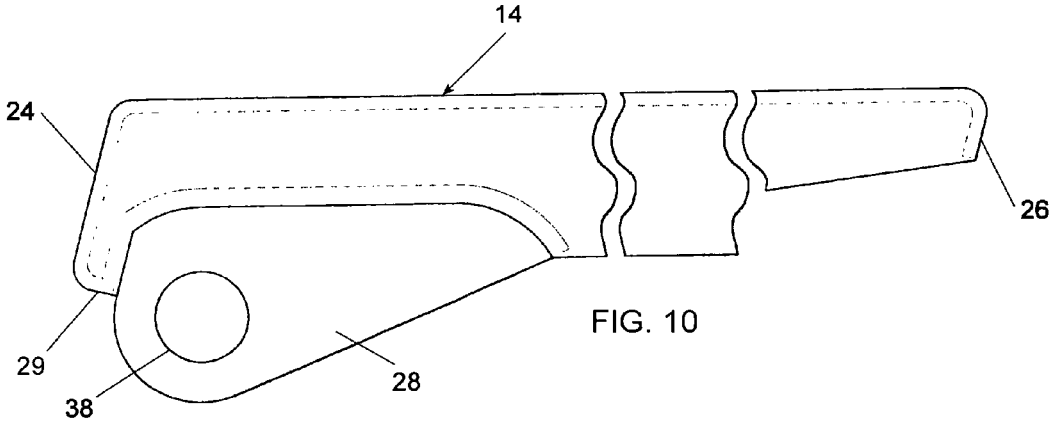
FIG. 10 shows a foreshortened side view of a support leg.
Figure 11:
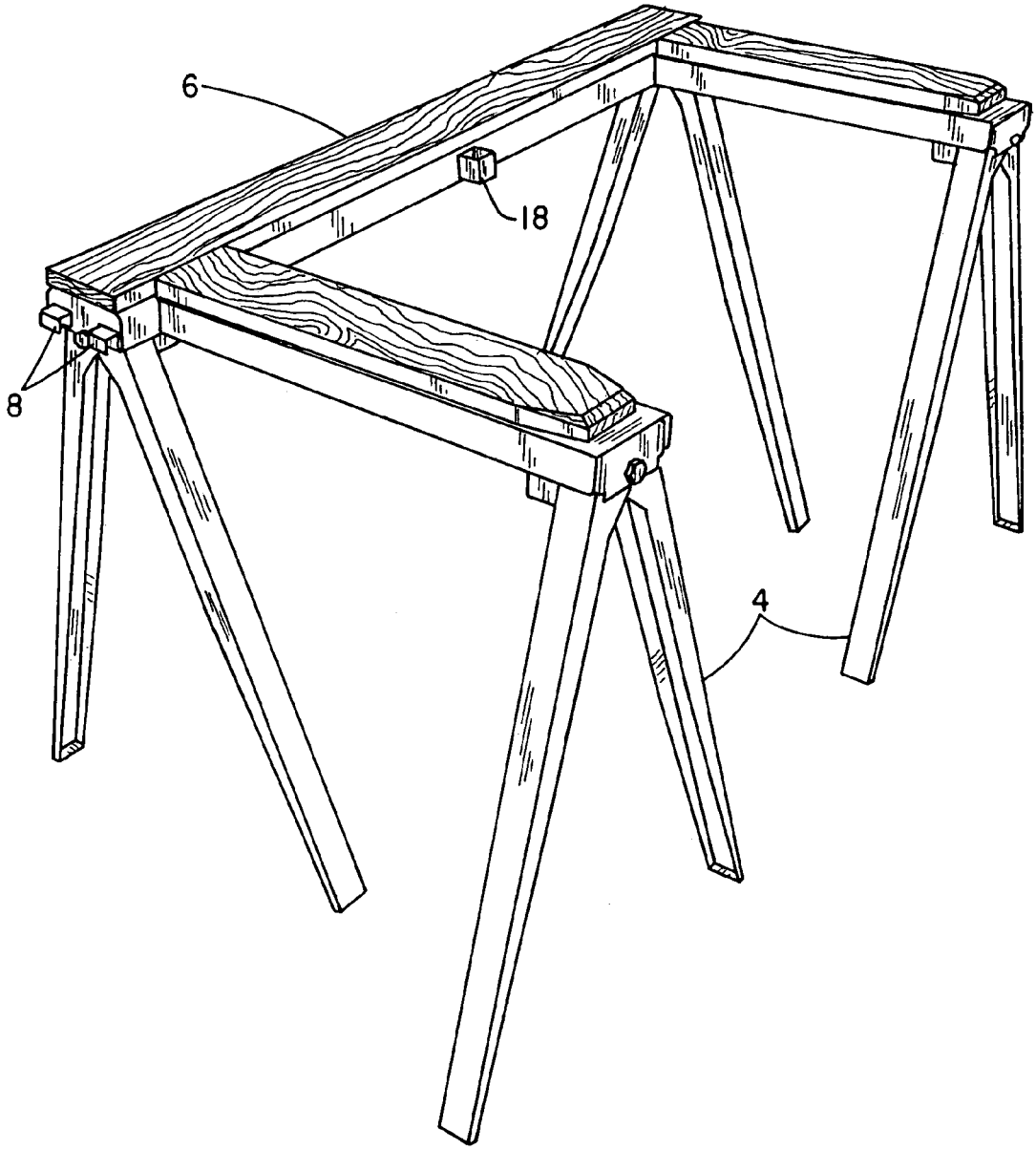
FIG. 11 shows an assembled perspective drawing of a C-shaped (when viewed from above) first arrangement of the wings along one side of the primary section.
Figure 12:
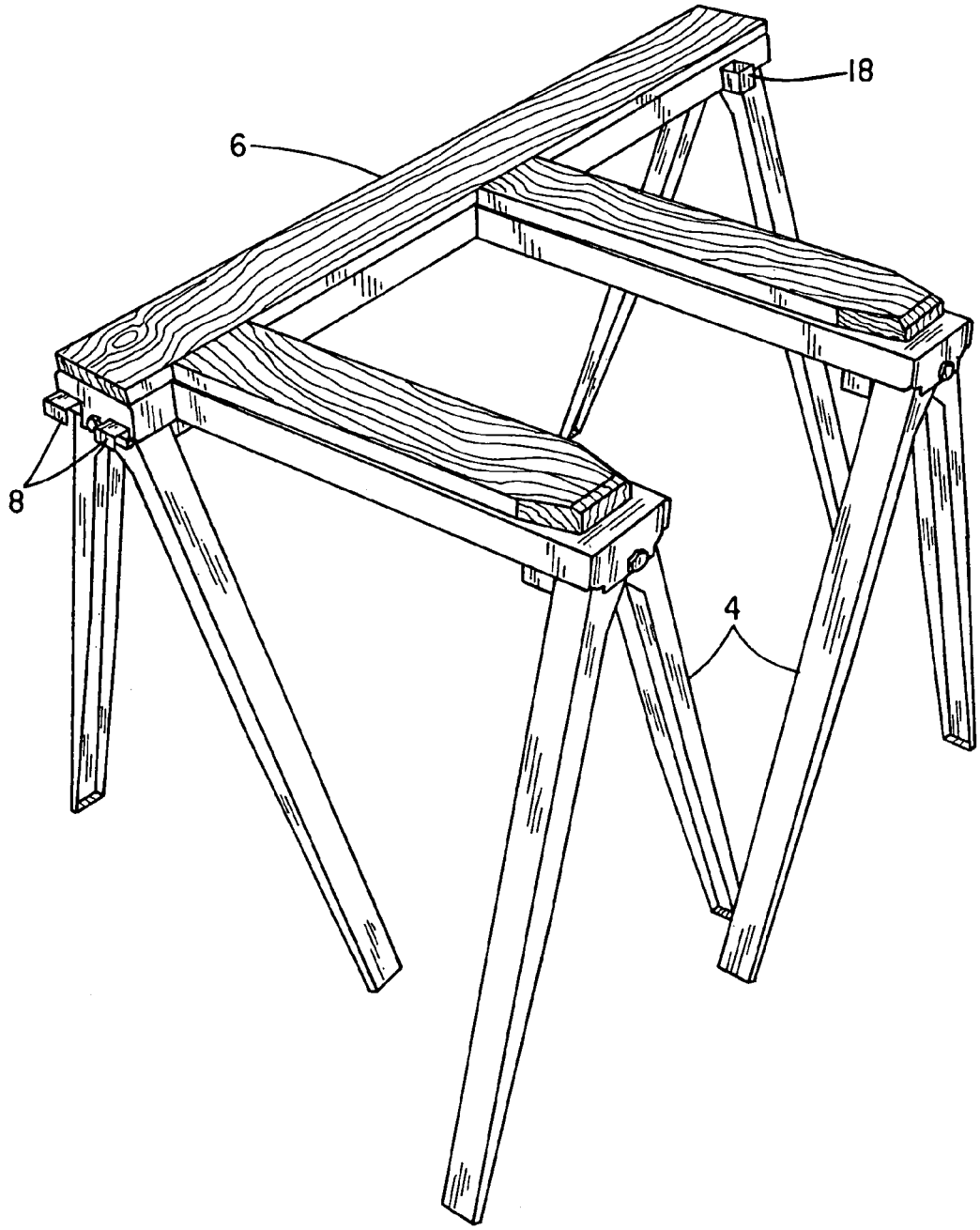
FIG. 12 shows an assembled perspective drawing of a second arrangement of the wings along one side of the primary section.
Figure 13:
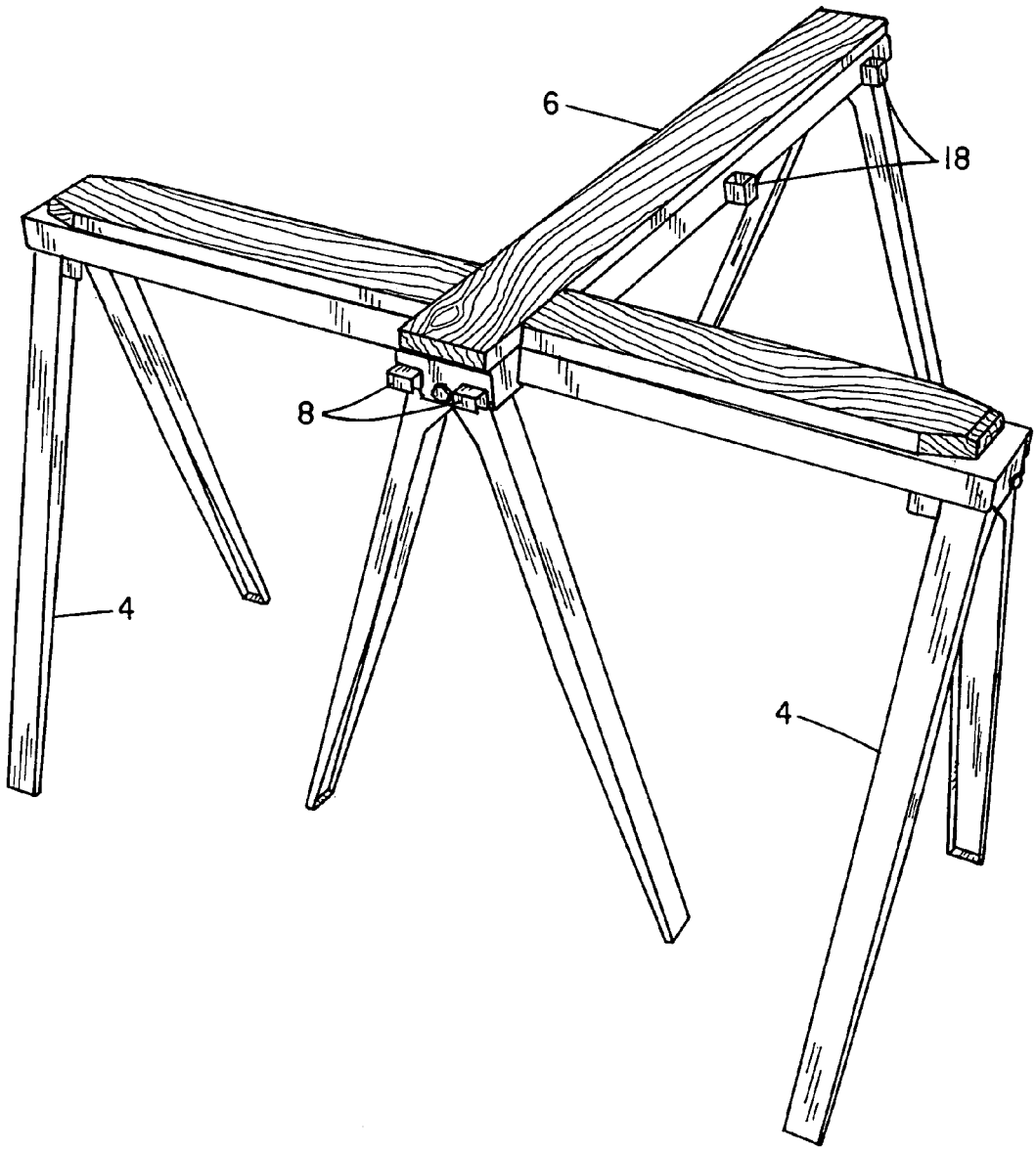
FIG. 13 shows an assembled perspective drawing of a third arrangement of the wings along opposite sides of the primary section.
Figure 14:
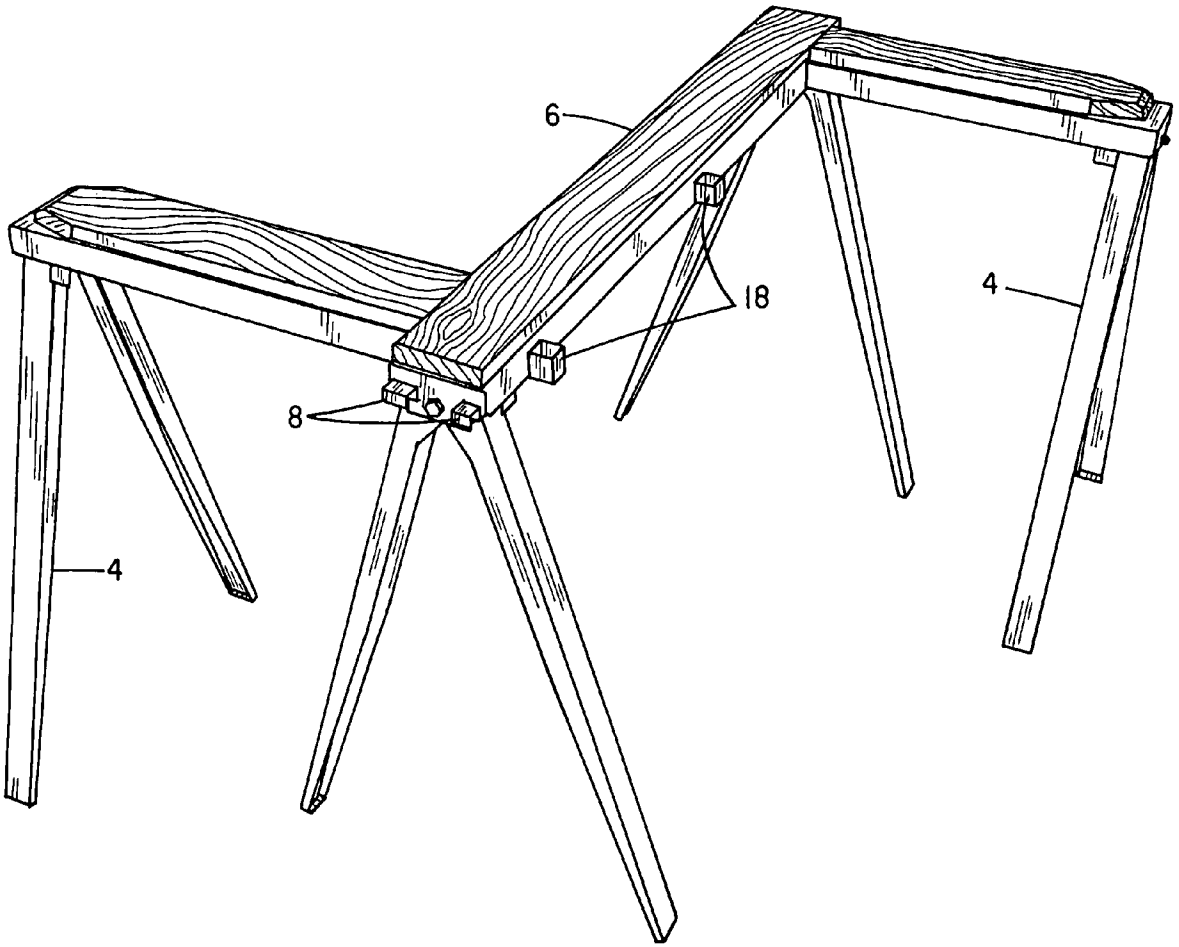
FIG. 14 shows an assembled perspective drawing of a T-shaped fourth arrangement of the wings along opposite sides of the primary section.
Figure 15:
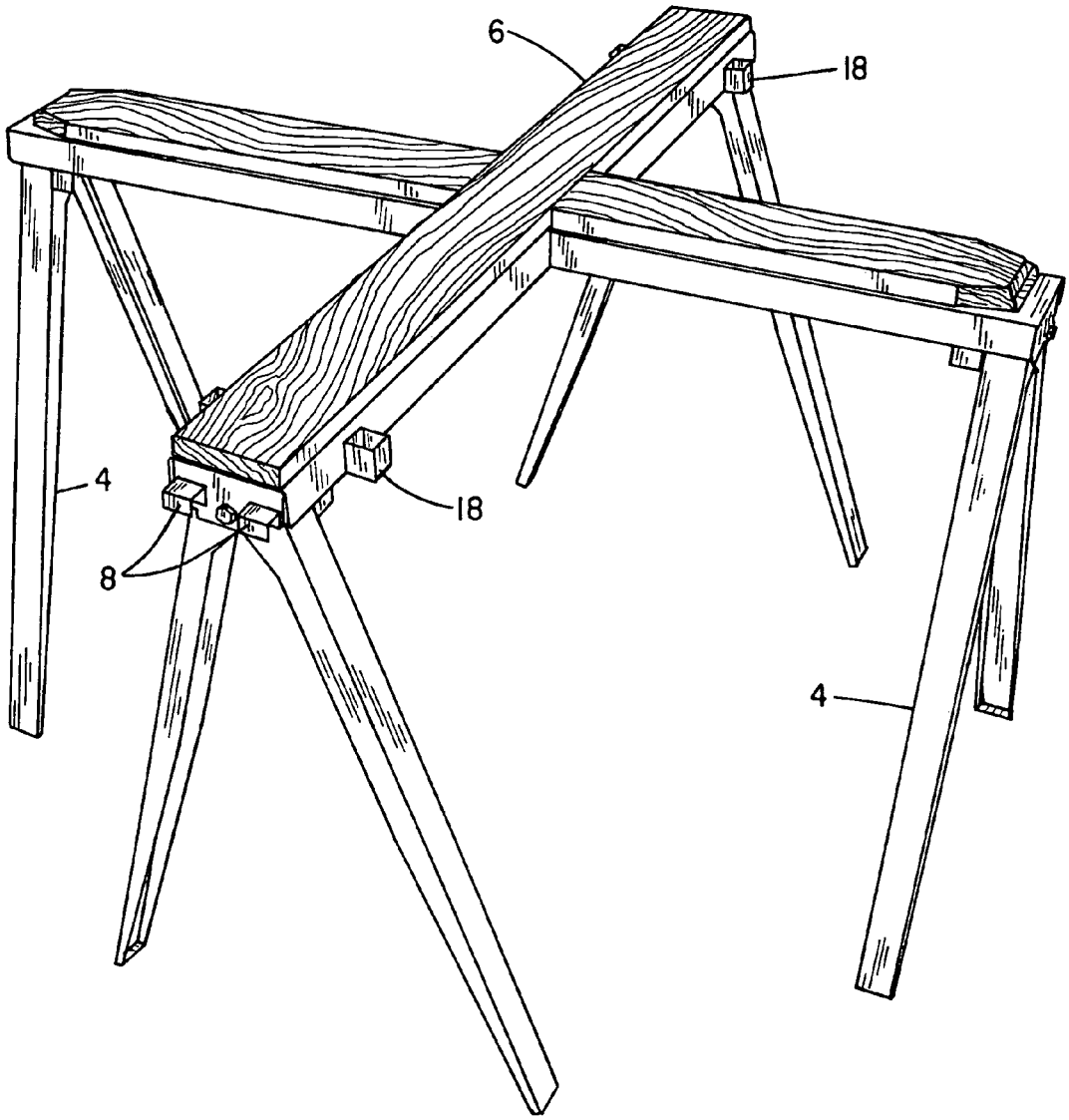
FIG. 15 shows an assembled perspective drawing of a fifth arrangement of the wings along opposite sides of the primary section.

The sidewalls of the legs 14 are separately formed with a longitudinal taper and the pivot ends adjacent the folds 24 are radiused with a relieved surface 28 shown at FIG. 10. The relieved surfaces 28 are also shown in overlapped relation at FIGS. 4 and 6 and which accommodate the rotation of the legs 14 to facilitate the A-shaped splay action of the legs 14. The relieved surfaces 28 permit the legs 14 to rotate in a range on the order of 20° to 45°. Contact between the stop surfaces 29 at the tabs 24 of the legs 14 further limits the range of leg splay rotation.

Each of the brackets 10 and 11 are secured to the appropriate ends of the rail support pieces 20 and 22 with rivet or pin fasteners 30 that mate with holes 32 formed in bracket flange arms 34 and 35. The pin fasteners 30 act as hinge pins to define a first axis of rotation and permit the rotation of the brackets 10 and 11 within the rail sections 20 and 22. The legs 14 rotate about the pins 30 between parallel and orthogonal alignments to the rail pieces 20 and 22.

Each pair of legs 14 is separately secured at the overlapping ends to one of the brackets 10 and 11 with a shouldered pivot pin or hinge bolt/nut fastener 36 secured through an aperture 38 at each leg 14 and an aperture 40 at each bracket 10 and 11. The fasteners 36 permit the legs 14 to rotate 90° relative to a second axis of rotation. The second axis allows the legs 14 to rotate between parallel and a splayed (i.e. A-shaped) orientation.

Tabs 42 are secured with rivets or other fasteners 43 to the opposite side webs of each rail piece 20 and 22 adjacent each hinge bracket 10 and 11. The tabs 42 act as stops to prevent the rotation of the legs 14 after they are folded open to an A-shaped condition. That is, the tabs 42 contact the channel piece side walls to prevent the legs 14 from folding or collapsing inward toward the rail pieces 20 and 22, once rotated to a splayed condition.

When the legs 14 are folded flat between the side webs of each rail piece 20 and 22, a bracket surface 44 and the retainers 8 at each bracket 10 lie parallel to the top webs of the rail pieces 20 and 22. In this condition, the edges of the rail pieces 22 readily mount beneath the retainers 8. When the legs 14 are rotated to extend at 90° to the rail pieces 20 and 22 and are splayed open, the tabs 42 prevent the legs 14 from folding inward. The bracket surfaces 44 and hinge bolts 36 then serve as end caps to the channel pieces 20 and 22.

While the primary section 6 can be used alone, more typically one or both of the wing sections 4 are attached to enhance the stability of the primary section 6. FIGS. 11–15 depict a variety of different mounting configurations that can be obtained. Depending upon the work piece and/or task to be performed, a preferred arrangement is obtained by fitting the pins 16 to the appropriate sockets 18.

Presently, the primary section 6 extends approximately 36 to 40-inches and the wing sections 4 extend approximately 18 to 20-inches. The legs 14 extend approximately 26-inches and splay apart approximately 14-inches to 18-inches. The sockets 18 are also spaced apart at the rail piece 22 and located to prevent overlap of the legs 14 when secured to adjacent sockets 18. The foregoing dimensions permit the assembly 2 to readily support 4-foot×8-foot sheets of plywood, paneling, plasterboard, cement board among sundry other work pieces.

While the invention has been described with respect to considered alternative assemblies and considered improvements or alternatives thereto, still other assemblies may be suggested to those skilled in the art. It is also to be appreciated that selected ones of the foregoing components can be used singularly or can be arranged in different combinations to provide a variety of further improved sawhorse and work piece support assemblies. For example, the primary section can be used alone or with one or both of the wing sections. The foregoing description should therefore be construed to include all those embodiments within the spirit and scope of the following claims.

What is claimed is:

1. A work piece support assembly comprising:

a) a primary support section having a primary rail member and first and second sets of paired legs pivotally secured to said primary rail member and wherein said primary rail member includes a plurality of coupler joints;

b) a wing section having a wing rail member, a third paired set of legs pivotally coupled to said wing rail member and a coupling member that mates with at least one of said plurality of coupler joints;

c) wherein each of said first, second and third set of paired legs is respectively coupled to said primary and wing rail members with a bi-axial hinge bracket, wherein said hinge bracket includes a base piece and first and second arms that depend from said base piece, wherein said first and second arms are mounted to pivot along a first axis and deploy said first, second and third paired set of legs between a parallel and an orthogonal mounting condition relative to said primary and wing rail members, and wherein first and second sets of paired legs are mounted to said base piece to pivot along a second axis relative to one another between a parallel and a splayed condition; and d) whereby said assembly can be deployed between a storage condition wherein said first, second and third lets of paired legs are folded parallel to said primary and wing rail members and said primary and wing sections are stacked on each other and a support condition wherein said first, second and third sets of paired legs are splayed apart, rotated orthogonal to said primary and wing rail members and said coupling member is fitted to a selected one of said plurality of coupler joints to project from said primary rail member to collectively define a support surface.

2. A work piece support assembly as set forth in claim 1 including a second wing section having a fourth set of legs and wherein said hinge brackets that support said first and second sets of paired legs include a retainer member that couple to the hinge brackets of said first and second wing sections.

3. A work piece support assembly as set forth in claim 2 wherein in said storage condition said third and fourth sets of paired legs overlap such that a portion of one of said third and fourth sets of paired legs project to define a handgrip.

4. A work piece support assembly as set forth in claim 1 wherein said plurality of coupler joints comprise sockets and wherein said coupler member comprises a pin and including a fastener for securing said first and second wing sections to one another when fitted in said storage condition to said primary support section.

5. A work piece support assembly as set forth in claim 1 wherein said coupler joints comprise sockets and wherein said coupler member comprises a pin.

6. A work piece support assembly as set forth in claim 5 wherein said sockets and pin interconnect in non-rotative relation.

7. A work piece support assembly as set forth in claim 1 wherein said first and second sets of paired legs include overlapping recessed surfaces that limit relative rotational leg movement.

8. A work piece support assembly as set forth in claim 1 including a stop member coupled to said primary and wing rail members to prevent said first, second and third sets of paired legs from rotating once splayed open to said support condition.

9. A work piece support assembly as set forth in claim 1 wherein said primary and wing rail members are covered with a cover piece.

10. A work piece support assembly comprising:

a) a primary support section having a primary rail member and first and second sets of paired legs pivotally secured to said primary rail member and wherein said primary rail member includes a plurality of coupler joints;

b) first and second wing sections respectively having first and second wing rail members, third and fourth paired set of legs pivotally coupled to said first and second wing rail members and a coupling member that mates with at least one of said plurality of coupler joints;

c) wherein each of said first, second, third and fourth sets of paired legs is respectively coupled to said primary and first and second wing rail members with a bi-axial hinge bracket, wherein said hinge bracket includes a base piece and first and second arms that depend from said base piece, wherein said first and second arms are mounted to pivot along a first axis and deploy said first, second, third and fourth sets of paired legs between a parallel and an orthogonal mounting condition relative to said primary and first and second wing rail members, and wherein first and second sets of paired legs are mounted to said base piece to pivot along a second axis relative to one another between a parallel and a splayed condition; and d) whereby said assembly can be deployed between a storage condition wherein said first, second, third and fourth sets of paired legs are folded parallel to said primary and first and second wing rail members and said primary and first and second wing sections are stacked on each other and a support condition wherein said first, second, third and fourth sets of paired legs are splayed apart, rotated orthogonal to said primary and first and second wing rail members and said coupling member is fitted to a selected one of said plurality of coupler joints to project from said primary rail member to collectively define a support surface.

11. A work piece support assembly as set forth in claim 10 wherein said first and second sets of paired legs include overlapping recessed surfaces that limit relative rotational leg movement.

12. A work piece support assembly as set forth in claim 10 including a stop member coupled to said primary and wing rail members to prevent said first, second and third sets of paired legs from rotating once rotated to said support condition and splayed open.

13. A work piece support assembly as set forth in claim 10 wherein said plurality of coupler joints comprise sockets and wherein said coupler member comprises a pin and including a fastener for securing said first and second wing sections to one another when fitted in said storage condition to said primary support section.

* * * * *